US010344620B2

(12) United States Patent
Simms et al.

(10) Patent No.: US 10,344,620 B2
(45) Date of Patent: Jul. 9, 2019

(54) AIR COOLED COMPONENT FOR A GAS TURBINE ENGINE

(71) Applicant: ROLLS-ROYCE PLC, London (GB)

(72) Inventors: Mark J Simms, Bristol (GB); Edward J Smith, Bath (GB)

(73) Assignee: ROLLS-ROYCE plc, London (GB)

( * ) Notice: Subject to any disclaimer, the term of this patent is extended or adjusted under 35 U.S.C. 154(b) by 123 days.

(21) Appl. No.: 15/645,157

(22) Filed: Jul. 10, 2017

(65) Prior Publication Data

US 2018/0023415 A1 Jan. 25, 2018

(30) Foreign Application Priority Data

Jul. 21, 2016 (GB) ..... 1612646.8

(51) Int. Cl.

| | |
|---|---|
| ***F01D 25/00*** | (2006.01) |
| ***F01D 25/12*** | (2006.01) |
| ***F01D 11/08*** | (2006.01) |
| ***F01D 25/28*** | (2006.01) |
| *F01D 25/24* | (2006.01) |

(52) U.S. Cl.

CPC ..... *F01D 25/12* (2013.01); *F01D 11/08* (2013.01); *F01D 25/28* (2013.01); *F01D 25/246* (2013.01); *F05D 2220/32* (2013.01); *F05D 2240/11* (2013.01); *F05D 2240/55* (2013.01); *F05D 2260/201* (2013.01)

(58) Field of Classification Search

CPC ..... F01D 25/10; F01D 25/12; F01D 11/08; F01D 25/28; F05D 2220/32

See application file for complete search history.

(56) References Cited

U.S. PATENT DOCUMENTS 3,603,599 A * 9/1971 Laird ..... F01D 11/127 277/414
3,730,640 A * 5/1973 Rice ..... F01D 11/08 415/117
4,497,610 A * 2/1985 Richardson ..... F01D 9/04 415/116
4,526,226 A * 7/1985 Hsia ..... F01D 5/187 165/109.1
5,169,287 A * 12/1992 Proctor ..... F01D 5/182 415/115

(Continued)

FOREIGN PATENT DOCUMENTS

EP 2369139 A2 9/2011
EP 2369139 A3 2/2015

OTHER PUBLICATIONS

Nov. 13, 2017 Search Report issued in European Patent Application No. 17180428.

(Continued)

*Primary Examiner* — Thomas N Moulis
(74) *Attorney, Agent, or Firm* — Oliff PLC

(57) ABSTRACT

An air cooled component for a turbine stage of a gas turbine engine, comprising: a main body having radially inner main gas path wall and a cooling chamber, the main gas path wall separating the main gas path of the turbine stage and the cooling chamber; at least one flange extending from the main body; a cooling cavity enclosed within the flange; and, an inlet conduit extending between and fluidically connecting the cavity and cooling chamber.

20 Claims, 3 Drawing Sheets

(56) References Cited

U.S. PATENT DOCUMENTS 5,486,090 A * 1/1996 Thompson ..... F01D 11/08 415/173.1
5,538,393 A * 7/1996 Thompson ..... F01D 11/08 415/115
6,155,778 A * 12/2000 Lee ..... F01D 5/20 415/116
7,033,138 B2 * 4/2006 Tomita ..... F01D 11/005 415/139
7,665,962 B1 * 2/2010 Liang ..... F01D 11/24 415/173.1
7,670,108 B2 * 3/2010 Liang ..... F01D 11/005 415/115
8,727,704 B2 * 5/2014 Lee ..... F01D 11/08 415/116
9,017,012 B2 * 4/2015 Brunelli ..... F01D 25/12 415/115
9,784,125 B2 * 10/2017 Duguay ..... F01D 25/12
9,963,996 B2 * 5/2018 Eng ..... F01D 9/04
10,107,128 B2 * 10/2018 Romanov ..... F01D 11/08
2001/0021343 A1 * 9/2001 Kuwabara ..... F01D 5/187 415/115
2003/0131980 A1 * 7/2003 DeMarche ..... F01D 11/24 165/169
2004/0146399 A1 * 7/2004 Bolms ..... F01D 25/12 415/175
2005/0058534 A1 * 3/2005 Lee ..... F01D 5/288 415/116
2006/0073011 A1 * 4/2006 Lee ..... F01D 5/187 415/191
2007/0041827 A1 * 2/2007 Camus ..... F01D 9/04 415/116
2007/0253816 A1 * 11/2007 Walz ..... F01D 5/186 416/97 R
2009/0035125 A1 * 2/2009 Fujimoto ..... F01D 11/24 415/116
2011/0044805 A1 * 2/2011 Koyabu ..... F01D 11/08 415/177
2011/0236199 A1 * 9/2011 Bergman ..... F01D 9/02 415/208.1
2012/0257954 A1 * 10/2012 Chanteloup ..... F01D 5/187 415/1
2013/0028727 A1 * 1/2013 Shinoda ..... F01D 9/065 415/208.1
2013/0343873 A1 * 12/2013 Spangler ..... F01D 17/162 415/115
2014/0219778 A1 * 8/2014 Boeke ..... F01D 25/12 415/115
2016/0032746 A1 * 2/2016 Jenkins ..... F01D 25/246 415/173.1
2016/0090866 A1 * 3/2016 Hurst ..... F01D 25/246 415/173.1
2016/0186606 A1 * 6/2016 Blaney ..... F01D 5/081 415/116
2018/0230832 A1 * 8/2018 Dierksmeier ..... F01D 5/082
2018/0363502 A1 * 12/2018 Dziech ..... F01D 25/243

OTHER PUBLICATIONS

Jan. 18, 2017 Search Report issued in Great Britain Patent Application No. GB1612646.8.

* cited by examiner

AIR COOLED COMPONENT FOR A GAS TURBINE ENGINE

TECHNICAL FIELD OF INVENTION

The present invention relates to an air cooled component for a gas turbine engine. In particular, the invention relates to an air cooled seal segment having a flange with a cavity therein.

BACKGROUND OF INVENTION

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

Compressed air from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

The performance of gas turbine engines, whether measured in terms of efficiency or specific output, is improved by increasing the turbine gas temperature. It is therefore desirable to operate the turbines at the highest possible temperatures. For any engine cycle compression ratio or bypass ratio, increasing the turbine entry gas temperature produces more specific thrust (e.g. engine thrust per unit of air mass flow). However as turbine entry temperatures increase, the life of an un-cooled turbine falls, necessitating the development of better materials and the introduction of internal air cooling.

In modern engines, the high-pressure turbine gas temperatures are hotter than the melting point of the material of the blades and vanes, necessitating internal air cooling of these airfoil components. During its passage through the engine, the mean temperature of the gas stream decreases as power is extracted. Therefore, the need to cool the static and rotary parts of the engine structure decreases as the gas moves from the high-pressure stage(s), through the intermediate-pressure and low-pressure stages, and towards the exit nozzle.

FIG. 2 shows an isometric view of a typical single stage cooled turbine in which there is a nozzle guide vane in flow series with a turbine rotor. The nozzle guide vane includes an aerofoil 31 which extends radially between inner 32 and outer 33 platforms. The turbine rotor includes a blade mounted to the peripheral edge of a rotating disc. The blade includes an aerofoil 32 which extends radially outwards from an inner platform. The radially outer end of the blade includes a shroud which sits within a seal segment 35. The seal segment is a stator component and attached to the engine casing. The arrows in FIG. 2 indicate cooling flows.

Internal convection and external films are the prime methods of cooling the gas path components—airfoils, platforms, shrouds and shroud segments etc. High-pressure turbine nozzle guide vanes (NGVs) consume the greatest amount of cooling air on high temperature engines. High-pressure blades typically use about half of the NGV flow. The intermediate-pressure and low-pressure stages downstream of the HP turbine use progressively less cooling air.

The high-pressure turbine airfoils are cooled by using high pressure air from the compressor that has by-passed the combustor and is therefore relatively cool compared to the gas temperature. Typical cooling air temperatures are between 800 and 1000 K, while gas temperatures can be in excess of 2100 K.

The cooling air from the compressor that is used to cool the hot turbine components is not used fully to extract work from the turbine. Therefore, as extracting coolant flow has an adverse effect on the engine operating efficiency, it is important to use the cooling air effectively.

Ever increasing gas temperature levels combined with a drive towards flatter combustion radial profiles, in the interests of reduced combustor emissions, have resulted in an increase in local gas temperature experienced by the extremities of the blades and vanes, and the working gas annulus endwalls.

In other examples, the turbine blades may be so-called shroudless blades in which there is no platform on the free end of the turbine blades. Such blades rotate radially inwards of a gas path wall commonly referred to as a seal segment. This is similar to the seal segment shown in FIG. 2 and includes a radially outer chamber which is provided with cooling air to keep the component cool during use. It is also well known to provide impingement cooling to the exterior of the gas path wall of a seal segment.

Cooling of the NGV end wall is achieved with the use of cooling air which is provided on the radial outer and radial inner of the gas path wall in appropriate chambers. From here the cooling air travels inside the vanes and through film cooling holes and the like as described above.

Typically, components of a gas turbine engine are metallic and cast and machined. Cavities may be cast during the casting of the piece, or machined in at a later date. These fabrication techniques generally mean that the geometry of the cavities need to be simple with the cooling air feed and exit holes created separately usually via secondary machining. Typical tolerances of these fabrications ultimately limit how small they can become and how closely they can mirror the base segment's shape.

Cast cavities can allow detailed features to be formed, however, because the ceramic cores used to make the cavities are prone to movement during the casting process they ultimately limit the smallest wall thickness that can be achieved which can result in unnecessarily thick walls and additional weight penalties.

Additionally, because the ceramic cores need to be held during the casting process the cavities either need to incorporate cores which project beyond and thus through the component wall, or are tied to other components with reasonably large ceramic bridges or vias. These bridges will interconnect the various cavities formed within the part in ways that may limit the ability to direct cooling flow between the various cavities in a controlled manner to enable efficient cooling function.

EP2369139 describes a nozzle segment for a gas turbine engine includes a flange which extends from a vane platform, the flange including a hollow cavity to reduce the weight of the component. The hollow cavity may include one or more purge openings.

The present invention seeks to provide an alternative air cooled component which can be fabricated by an additive layer manufacturing technique to provide an improved cooling functionality.

STATEMENTS OF INVENTION

The present invention provides an air cooled component according to the appended claims.

Disclosed below is an air cooled component for a turbine stage of a gas turbine engine which may comprise: a main body having radially inner main gas path wall and a cooling chamber, the main gas path wall separating the main gas path of the turbine stage and the cooling chamber. The component may have an attachment system providing radial retention of the component. The attachment system may comprise at least one flange extending from the main body. A cooling cavity may be enclosed within the flange; and, an inlet conduit extending between and fluidically connecting the cavity and cooling chamber.

Providing a cooling cavity in a flange in such a way provides an increased cooling of a part. Further, the additional cavity reduces weight in the component which is advantageous for aerospace embodiments.

The component may further comprise at least one outlet conduit extending between and fluidically connecting the cavity and a second cooling chamber.

The cooling chamber may include first and second sub-chambers, the first and second sub-chambers being separated by a partitioning wall having one or more pressure reducing apertures such that the operating pressure of the first and second sub-chambers is different. At least one outlet conduit may extend between and fluidically connect the cavity and second sub-chamber.

The cavity may be defined in part by a main gas path wall. The cavity may include one or more surface features to enhance heat transfer. Such surface features may include one or more turbulators in the form of pedestals, strips or other protuberant formations which extend from the surface into the cavity.

The flange may form part of a coupling for receiving another part of the turbine stage.

The cavity may be elongate and have a longitudinal axis. There may be a plurality of inlet and outlet conduits distributed along the longitudinally along the cavity. The inlet and outlet conduits may alternate along the length of the cavity.

The inlet conduit may include a cavity impingement exit which opposes a wall of the cavity such that flow impinges on the wall during use. The longitudinal axis of the inlet conduit may extend in more than one direction.

The inlet conduit may extend in a first direction and a second direction, in which the second direction is substantially radial. The cavity may be upstream or downstream of the cooling chamber and a first portion of the conduit may axially bridge between the cooling chamber and cavity.

The pressure reducing apertures of the first and second sub-chambers may be impingement holes. The impingement holes may be holes placed proximally opposite a facing wall such that, in use, a flow exiting the impingement hole impinges upon the wall. Impingement holes are well known in the art.

The cavity may be defined within the flange by one or more flange walk. At least one of the flange walls may define the cavity and has substantially uniform thickness in section. The flange may include a protuberant feature which extends from a body of the component. The flange may have uniform thickness in section or may be tapered or have a varying sectional profile. The thickness of the flange wall may be between 0.5 mm and 3 mm.

The cavity may be located entirely within the flange. The cavity may extend from the main body into the cavity.

The flange may form part of an attachment system. The flange may form part of a two part attachment system. The two part attachment system may include a male and a female part. The attachment system may be a bird's mouth attachment. The attachment may provide radial retention of the component.

Also described below is a seal segment for a gas turbine engine, comprising: a main gas path wall located radially outwards of a turbine rotor in use, at least one bird's mouth coupling, the bird's mouth coupling including at least one flange which houses a flange chamber which is in fluid communication with a first cooling chamber via an inlet passageway.

The flange cavity is elongate and extends circumferentially around a principal rotational axis of the gas turbine engine, and includes a plurality of inlet passageways distributed circumferentially along the flange cavity.

The flange cavity may include a plurality of outlet passageways distributed circumferentially along the flange cavity.

The outlet passageways may be between the inlet passageways. The flange may include a wall which provides the main gas path wall of the seal segment.

Within the scope of this application it is expressly envisaged that the various aspects, embodiments, examples and alternatives, and in particular the individual features thereof, set out in the preceding paragraphs, in the claims and/or in the following description and drawings, may be taken independently or in any combination. For example features described in connection with one embodiment are applicable to all embodiments, unless such features are incompatible.

DESCRIPTION OF DRAWINGS

Embodiments of the invention will now be described with the aid of the following drawings of which.

DETAILED DESCRIPTION OF INVENTION

It will be appreciated that, in the following description, axial and radial are used with reference to the principal axis of rotation of the engine, and upstream and downstream, fore and aft, are used in relation to the main gas path direction, unless otherwise stated.

Figure 1:
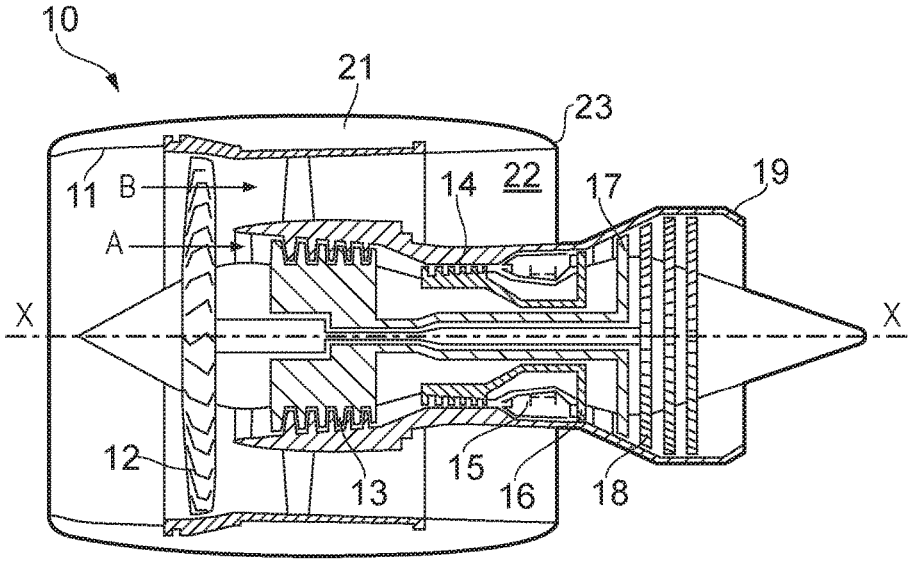
FIG. 1 shows a longitudinal schematic section of a conventional gas turbine engine.
Figure 2:
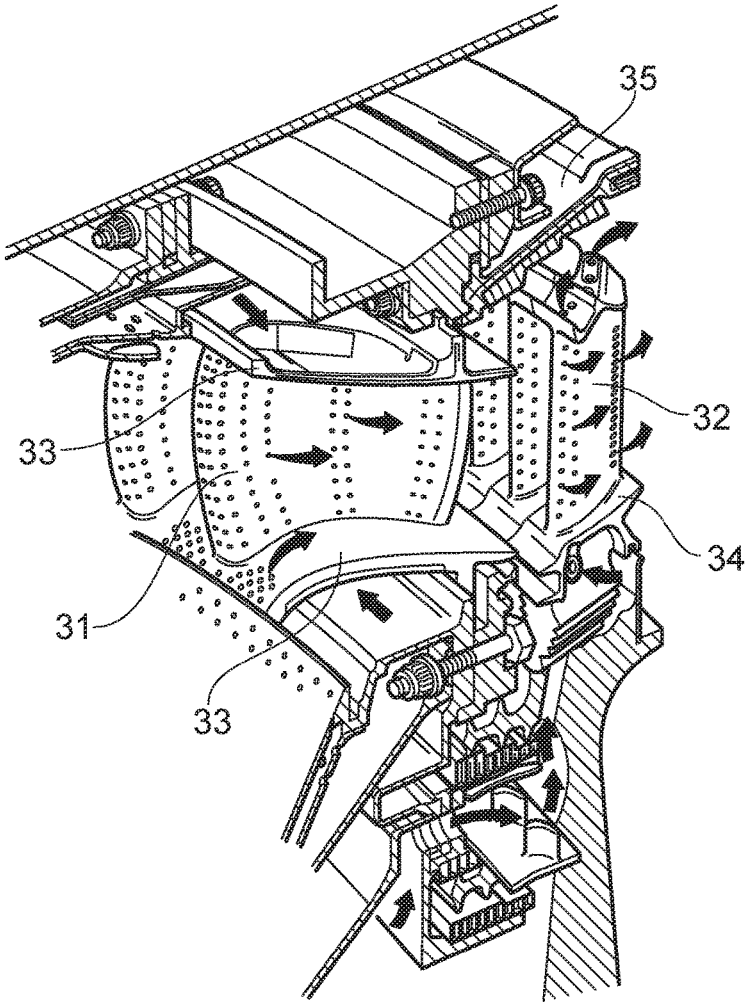
FIG. 2 shows a perspective view of a turbine stage.
Figure 3:
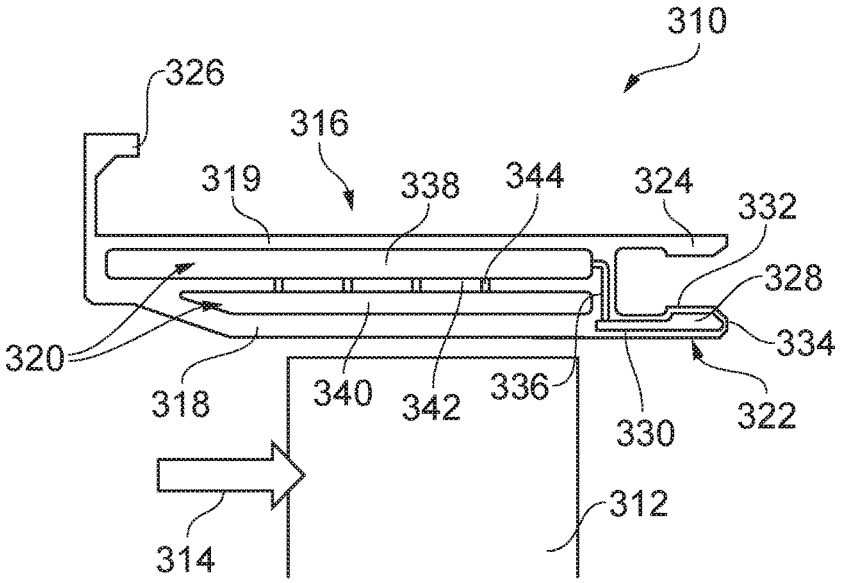
FIG. 3 shows a longitudinal schematic section of a seal segment.

FIG. 3 shows an air cooled component in the form of a seal segment 310 for a turbine stage of a gas turbine engine. The turbine stage may be the high pressure turbine similar to the one shown in FIG. 2. Alternatively, the air cooled component may be a platform or a nozzle guide vane for example. The seal segment 310 sits radially outside of the rotor and rotor blade tips 312 and defines an axial portion of the main gas path which is indicated by arrow 314.

The seal segment 310 includes a main body 316 having radially inner main gas path wall 318 and a radially outer cooling chamber generally indicated by 320. The main gas path wall 318 defines the main gas path 314 of the turbine stage and separates it from the cooling chamber 320.

The cooling chamber 320 is connected to and receives in use cooling air from a suitable source of pressurised air. Typically, the source of cooling air is taken from an appropriate stage of the compressor as is generally known in the art. The cooling chamber 320 may include one or more inlet apertures and exit apertures (not shown) which provide a suitable flow of cooling air for distribution through the air cooled component.

The seal segment 310 includes one or more flanges 322, 324, 326 which may be any protuberant feature extending from a fixed end on the main body 316 to a free end so as to be generally cantilevered from the main body. The flange 322 will generally be a subservient or minor feature relative to the main body 316.

The flange 322 may be elongate having the fixed end along its length. The lowest one of the flanges 322 includes a portion which is exposed to the gas path 314 of the turbine stage. As such, the flange may include a surface which is a continuation of the main body gas path wall and be flush therewith.

The flange 322 may form part of an attachment for receiving a corresponding part of another part of the turbine stage or engine. The attachment device may be in the form of a bird's mouth attachment in which there is provided a circumferentially extending slot having axial length and radial depth. The slot is defined by two radially opposing circumferentially extending walls which define a space therebetween for accepting a male counterpart to provide a two part attachment commonly known in the art.

The two radially separated circumferentially extending walls are provided by respective radially outer and a radially inner flanges. A cavity may be provided in either or both of the flanges. A third flange 326 is provided on the radially outer edge of the main body and provides a male part of a bird's mouth coupling for mounting on a corresponding slot of the engine casing or a carrier for example. Although the described flanges are all part of a bird's mouth fitting, this need not be the case, and alternative flanges may benefit from the invention.

The seal segment 310, or more generally, air cooled component, may be mounted to another part of the turbine stage or engine. For example, the component may mounted to one of the group consisting of a carrier, a casing or an adjacent seal segment 310 or vane structure. Alternatively, the part received by the coupling may be from an adjacent or intermediate stage or section of the engine. The alternative section may be part of or an extension to the combustor for example.

The flange 322 includes a cavity 328 therein for receiving cooling air. The cavity 328 is in the form of a hollow within the flange and may be located partially or fully within the flange 322. Where the cavity 328 is located partially within the flange 322, it will be appreciated that the majority of the cavity 328 will be located within the flange 322.

In the described embodiment, the cavity 328 provides a hollow interior to the flange 322 and is defined on three sides by walls which provide the external surface of the flange 322. Thus, there are first 330 and second 332 radially spaced walls having the cavity therebetween and an end wall 334 which extends between the two radially spaced walls. The final wall of the cavity 328 is provided by the main body 316. The external shape of the flange 322 may be any required for an intended purpose. One or more of the cavity defining walls may have a uniform thickness in section. Thus, the cavity 328 may have a sectional shape similar to the that of the external shape of the flange 322.

The cavity 328 is supplied with cooling air via one or more conduits or passageways 336 which extend between the cooling chamber 320 and the cavity 328. The cavity 328 will also include at least one exit passageway or aperture which may connect between the cavity and a second cooling chamber, or externally to the air cooled components such as to the main gas flow path.

The cooling chamber 320 is defined by a gas path wall 318 and radially outer wall 319 may include first 338 and second 340 sub-chambers. The first 338 and second 340 sub-chambers may be provided by a wall 342 which fluidically partitions the cooling chamber 320. In the example, the first 338 and second 340 sub-chambers are radially disposed relative to one another so as to have a radially inner sub-chamber 340 adjacent to and defined by the gas path wall 318, and a radially outer sub-chamber which serves as a plenum for supplying the second sub-chamber 340.

The first 338 and second 340 sub-chambers may be substantially planar having major dimensions extending circumferentially and axially, with a minor radial component. It will be understood The partitioning wall 342 may be integrally formed with the main body 316 of the seal segment 310 to provide a homogenous structure made with a common material, or may be a sheet metal part inserted within or fixed to the main body 316. The seal segment 310 may be made entirely by casting and machining, cast bond process in which separate parts are cast and bonded together, or by using an additive layer process such as direct laser deposition.

A cooling air flow is provided from the outer sub-chamber 338 to the inner sub-chamber 340 via a plurality of passageways or apertures 344 which pass through the partitioning wall 342. The number and location of the connecting apertures 344 will be dependent on the cooling requirement of the component but there will likely be a circumferential and axial distribution across the partitioning wall to provide a spread of cooling air.

The apertures 344 may be located opposite the main gas path wall 318 so as to provide impingement holes 344 which have a size and position which cause the projection of the operating cooling air to impinge against and cool the main gas path wall 318. Impingement cooling is well known in the art.

As will be appreciated, the apertures 344 which extend between the first 338 and second 340 sub-chambers provides a restriction in flow area and associated pressure reduction.

Figures 4A, 4B, 4C:
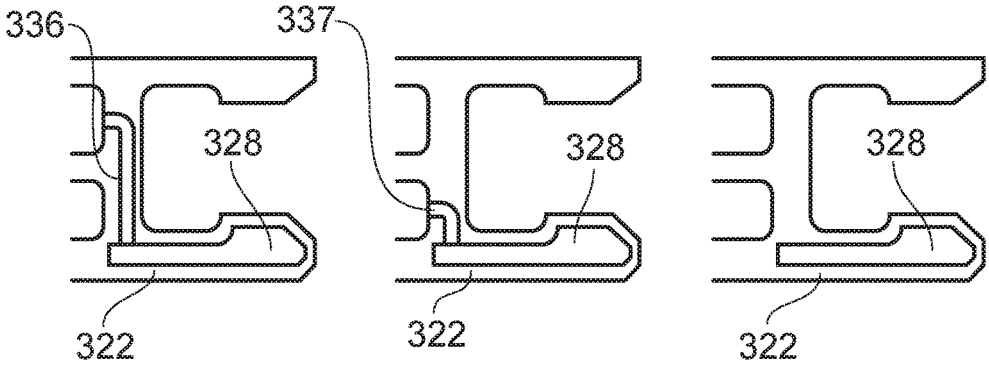
FIGS. 4*a*-4*c* show circumferentially spaced sections of seal segment flanges.

FIGS. 4*a* to 4*c* show sections of the seal segment at different circumferential positions around the principal axis of the engine. FIG. 4*a* has a position similar to that of FIG. 3.

The exit flow path may be defined by a second conduit 337 which links the cavity 328 to the one of other of the first and second sub-chambers. As shown in FIG. 4*b*, there is at least one exit passageway 337 which extends from the cavity 328 to the radially inner, lower pressure sub-chamber in contrast to FIG. 4*a* which has the inlet conduit 336 extending from the first higher pressure sub-chamber. FIG. 4*c* shows a mid-passageway section showing no connecting passageways. Thus, the inlet 336 and outlet 337 conduits alternate along the circumferential length of the cavity 328.

The number, distribution and relative size of the flow and return conduits 336, 337 may be provided to fulfill a predetermined cooling requirement. Further, the operating pressure differential provided between the first 338 and second 340 sub-chambers creates a flow of cooling air from first sub-chamber 338 to the second sub-chamber 340 via the cavity 328. There may be an equal number of alternating similarly sized passageways distributed along the component, or there could be an uneven distribution or groupings of conduits to provide a given flow pattern.

Either or both of the inlet and outlet conduits may be straight or may, as is shown in FIG. 3, extend along a bent, curved or tortuous pathway. In the example of FIG. 3, the conduits include two straight portions extending in different directions and connected by a bend. The first and second straight portions may be at right angles to one another. The first straight portion may be extend axially; the second portion may extend radially.

The exit hole of the inlet conduit is located in a wall which opposes the internal surface of the gas path wall of the segment. The longitudinal axis of the inlet conduit is at an angle to the main gas path wall such that the trajectory of the cooling air flow is incidental on the internal surface of the wall so as to impinge thereon and provide cooling thereto. The angle of the longitudinal axis may be at 90 degrees to the internal surface of the main gas path wall.

The cavity may be upstream or downstream of the cooling chamber and either radially inside, outside or level with the cooling chamber. Hence, a first portion of the inlet and outlet conduits may axially bridge the cooling chamber and cavity, with the second portion providing a radial dimension. The inlet and outlet conduit openings into the cavity are provided at one end of the cavity. Thus, in the example of the FIG. 3 in which the cavity has an axial length, the conduit openings are located at one axial end.

Figure 5:
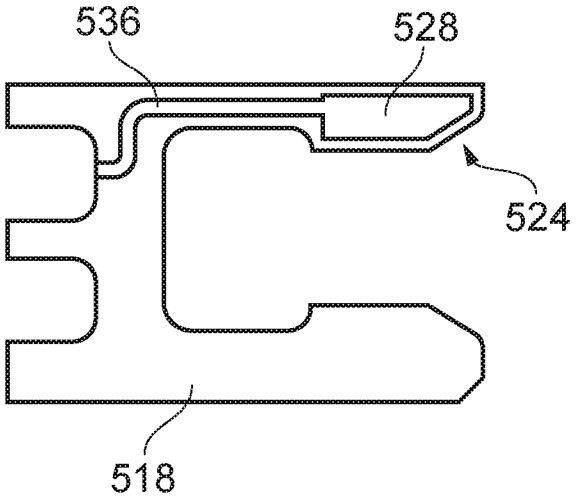
FIG. 5 shows another example of a seal segment flange.

The thicknesses of the flange walls may be between 0.5 to 3 mm. FIG. 5 shows a further example of a cavity cooling within a flange 524 in which the flange is radially separated from the main gas path wall 518. The flange may be part of an attachment and provide the opposing side of the attachment slot described in connection with FIG. 3.

Here, the cavity 528 is fully enclosed within the flange 522 and connected to the cooling chamber by a conduit 536 that extends predominantly axially and includes three straight portions, two axial and one radial, each separated by a ninety degree bend.

Figure 6:
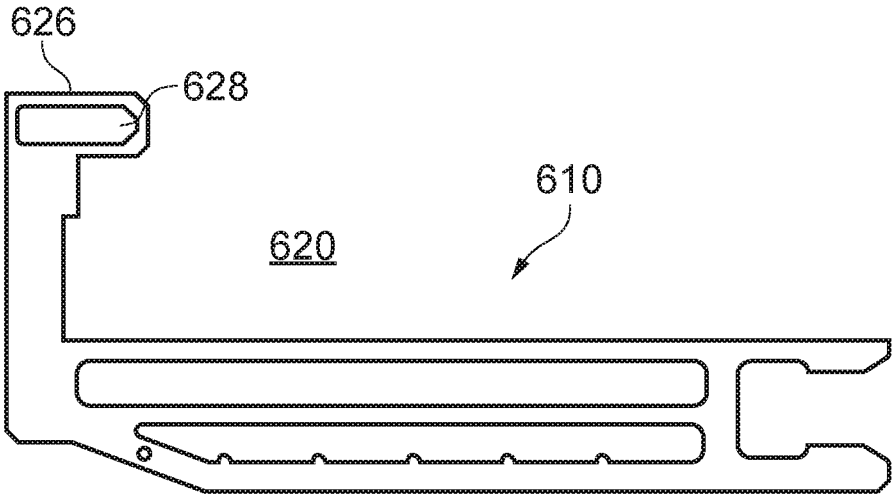
FIG. 6 shows yet another example of as seal segment.

FIG. 6 shows a yet further example in which a seal segment 610 includes a flange 626 positioned on the radial outside of the air cooled component. The flange 626 provides the male part of a bird's mouth attachment. Here the inlets and outlets can be provided along the axial length of the cavity 628 and may be into a chamber 620 which is on the outboard side of the component, rather than into a cooling chamber which is internal to the seal segment described in connection with the earlier Figures. The pressure differential can be provided by exiting the outlet to a lower pressure area.

It will be appreciated that the cavities described above may also include surface feature which enhance cooling. Such features may include turbulators in the form of pedestals or strips projecting from a surface into the cavity.

It will be understood that the invention is not limited to the described examples and embodiments and various modifications and improvements can be made without departing from the concepts described herein and the scope of the claims. Except where mutually exclusive, any of the features may be employed separately or in combination with any other features in the disclosure extends to and includes all combinations and sub-combinations of one or more described features.

The invention claimed is:

1. An air cooled component for a turbine stage of a gas turbine engine, comprising:

a main body having a radially inner main gas path wall and a first cooling chamber, the main gas path wall separating the main gas path of the turbine stage and the cooling chamber, the first cooling chamber including first and second sub-chambers, the first and second sub-chambers being separated by a partitioning wall having one or more pressure reducing apertures such that the operating pressure of the first and second sub-chambers is different;

an attachment system providing radial retention of the component, the attachment system comprising at least one flange extending from the main body;

a cooling cavity within the at least one flange;

at least one inlet conduit extending between and fluidically connecting the cavity and the first sub-chamber; and at least one outlet conduit extending between and fluidically connecting the cavity and the second sub-chamber.

2. The air cooled component as claimed in claim 1, wherein the cavity is defined in part by the radially inner main gas path wall.

3. The air cooled component as claimed in 1, wherein the flange forms part of a coupling for receiving another part of the turbine stage.

4. The air cooled component as claimed in claim 1, wherein the cavity is elongate and has a longitudinal axis, wherein there are a plurality of inlet conduits distributed along the longitudinal length of the cavity and a plurality of outlet conduits distributed along the longitudinal length of the cavity.

5. The air cooled component as claimed in claim 4, wherein the plurality of inlet conduits and plurality of outlet conduits alternate along the longitudinal length of the cavity.

6. The air cooled component as claimed in claim 1, wherein the at least one inlet conduit includes a cavity impingement exit which opposes a wall of the cavity such that flow impinges on the wall during use.

7. The air cooled component as claimed in claim 1 in which the at least one inlet conduit has a longitudinal axis which extends in more than one direction.

8. The air cooled component as claimed in claim 7, wherein the at least one inlet conduit extends in a first direction and a second direction, in which the second direction is substantially radial.

9. The air cooled component as claimed in claim 7, wherein the cavity is upstream or downstream of the first cooling chamber with respect to the main gas path wall and a first portion of the at least one inlet conduit axially bridges between the cooling chamber and cavity.

10. The air cooled component as claimed in claim 1, wherein the pressure reducing apertures are impingement holes.

11. The air cooled component as claimed in 1, wherein the cavity is defined within the flange by one or more flange walls, and at least one of the flange walls which define the cavity has substantially uniform thickness in section.

12. The air cooled component as claimed in claim 11, wherein the thickness of the at least one flange wall is 0.5 mm and 3 mm.

13. The air cooled component as claimed in claim 1, wherein the cavity is enclosed within the flange.

14. A seal segment for a gas turbine engine, comprising:

a main gas path wall located radially outwards of a turbine rotor in use, at least one bird's mouth coupling, the bird's mouth coupling including at least one flange which houses a flange chamber which is in fluid communication with a first cooling chamber via an inlet passageway.

15. The seal segment as claimed in claim 14, wherein the flange cavity is elongate and extends circumferentially around a principal rotational axis of the gas turbine engine and includes a plurality of inlet passageways distributed circumferentially along the flange cavity.

16. The seal segment as claimed in claim 15, wherein the flange cavity includes a plurality of outlet passageways distributed circumferentially along the flange cavity.

17. The seal segment as claimed in claim 16, wherein the outlet passageways are between the inlet passageways.

18. The seal segment as claim in claim 14, wherein the flange includes a wall which provides the main gas path wall of the seal segment.

19. An air cooled component for a turbine stage of a gas turbine engine, comprising:

a main body having a radially inner main gas path wall and a first cooling chamber, the main gas path wall separating the main gas path of the turbine stage and the cooling chamber;

an attachment system providing radial retention of the component, the attachment system comprising at least one flange extending from the main body;

a cooling cavity within the at least one flange; and at least one inlet conduit extending between and fluidically connecting the cavity and the cooling chamber, the at least one inlet conduit having a longitudinal axis which extends in more than one direction, such that the at least one inlet conduit includes a first portion that extends in a first direction and a second portion that extends in a second direction different from the first direction.

20. The air cooled component as claimed in claim 19, wherein the first portion and the second portion extend orthogonally to each other.

* * * * *